US008348685B2

(12) United States Patent
Liao et al.

(10) Patent No.: US 8,348,685 B2
(45) Date of Patent: Jan. 8, 2013

(54) USB CONNECTOR

(76) Inventors: Wen-Yung Liao, New Taipei (TW); Wen-Fu Liao, New Taipei (TW); Sheng-Hsin Liao, New Taipei (TW)

( * ) Notice: Subject to any disclaimer, the term of this patent is extended or adjusted under 35 U.S.C. 154(b) by 0 days.

(21) Appl. No.: 13/051,001

(22) Filed: Mar. 18, 2011

(65) Prior Publication Data

US 2012/0238146 A1 Sep. 20, 2012

(51) Int. Cl.
*H01R 13/44* (2006.01)

(52) U.S. Cl. ..... 439/131

(58) Field of Classification Search ..... 439/131, 439/172, 660; 174/560
See application file for complete search history.

(56) References Cited

U.S. PATENT DOCUMENTS 7,204,723 B2 * 4/2007 Sun ..... 439/701
D546,328 S * 7/2007 Kobayakawa ..... D14/480.4
D580,455 S * 11/2008 Elsener ..... D14/496
7,473,141 B2 * 1/2009 Liao ..... 439/638
7,488,215 B2 * 2/2009 Mayette et al. ..... 439/638
7,494,350 B1 * 2/2009 Lee ..... 439/131
7,607,950 B2 * 10/2009 Liao ..... 439/638
7,660,921 B2 * 2/2010 Schenk ..... 710/62
7,695,294 B2 * 4/2010 Lu ..... 439/141
7,857,639 B1 * 12/2010 Chang ..... 439/131
8,052,438 B1 * 11/2011 Hung ..... 439/131
8,066,521 B2 * 11/2011 Ma et al. ..... 439/131
8,100,725 B2 * 1/2012 Su et al. ..... 439/660
8,172,585 B2 * 5/2012 Chiu et al. ..... 439/108

* cited by examiner

*Primary Examiner* — Alexander Gilman
(74) *Attorney, Agent, or Firm* — Li & Cai Intellectual Property (USA) Office

(57) ABSTRACT

A USB connector is disclosed, which includes a first insulating body, a second insulating body, a plurality of first and second terminals, a first cover, and a second cover. A first module is defined by the first insulating body, the first terminals, and the first cover. A second module is defined the by second insulating body, the second terminals, and the second cover. The first and second modules are movably coupled relative to each other, for using independently or jointly.

6 Claims, 9 Drawing Sheets

USB CONNECTOR

BACKGROUND OF THE INVENTION

1. Field of the Invention

The instant disclosure relates to a networking connector; more particularly, to a USB (Universal Serial Bus) 3.0 connector.

2. Description of Related Art

The USB connectors are one of most commonly used networking connectors. Many computer peripherals are equipped with USB connectors for data transfer.

In particular, the USB 3.0 connector is designed to be backwards compatible with USB 2.0 connector. For smaller devices, the USE 3.0 Micro-B connectors have been developed. The micro-B type connectors are thinner, which are ideal for portable electronic devices such as mobile phones.

However, current USE 3.0 connectors (e.g. micro-B type) are made in one-piece. Namely, the first and second terminals are disposed on a same insulating body. Thus, the first and second terminals must be used simultaneously. In other words, the rust and second terminals can not be used separately, thereby limiting its capability.

SUMMARY OF THE INVENTION

The instant disclosure is to provide a USB connector, wherein a first module and a second module of the connector can be used separately or jointly.

The connector comprises: a first insulating body; a second insulating body; a plurality of first terminals disposed on the first insulating body in forming a first module; and a plurality of second terminals disposed on the second insulating body in forming a second module, wherein the first and second modules are arranged in parallel and are movably coupled via a coupling unit.

According to another aspect of the instant disclosure, a USB connector comprises: a first insulating body; a second insulating body; a plurality of first terminals disposed on the first insulating body forming a first module; and a plurality of second terminals disposed on the second insulating body forming a second module, wherein the first and second modules are stacked and are movably coupled via a coupling unit.

For the advantage, each of the first module and the second modules of the instant disclosure are an independent unit. Both modules can work individually or jointly. Thereby, the disclosed connector has a broader application range and more convenience.

In order to further appreciate the characteristics and technical contents of the instant disclosure, references are hereunder made to the detailed descriptions and appended drawings in connection with the instant disclosure. However, the appended drawings are merely shown for exemplary purposes, rather than being used to restrict the scope of the instant disclosure.

DETAILED DESCRIPTION OF PREFERRED EMBODIMENTS

Figure 1:
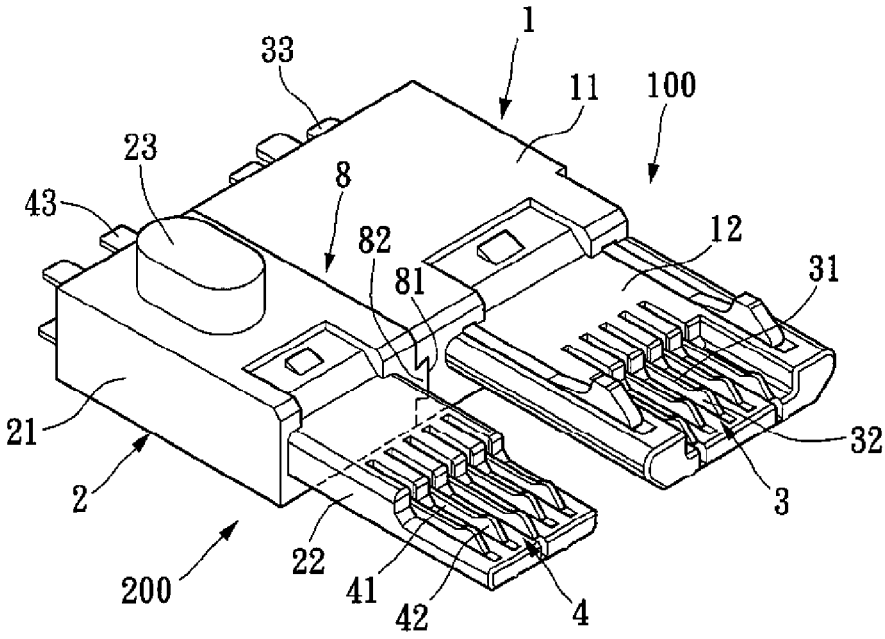
FIG. 1 shows a perspective view of a connector of a first embodiment of the instant disclosure.

Please refer to FIGS. 1~4, which show a USB connector of a first embodiment of the instant disclosure. The instant embodiment is of a high-frequency micro-USB type connector, which meets the specification of a USB 3.0 Micro-B connector. The connector comprises a first insulating body 1, a second insulating body 2, a plurality of first terminals 3, and a plurality of second terminals 4.

The first insulating body 1 has a first base portion 11, wherein a first tongue plate 12 extends forwardly from the first base portion 11. The first terminals 3 are disposed on the first insulating body 1. In particular, the first terminals 3 run through the first base portion 11 and are disposed on the first tongue plate 12. Functionally, the first terminals 3 are for USB 2.0 data communication. Each first terminal 3 has a first fixing portion 31, a first contacting portion 32, and a first soldering portion 33. The first fixing portion 31 is disposed on the first base portion 11 and through thereof. The first contacting portion 32 is formed by extending forward from the first fixing portion 31 and disposed on the first tongue plate 12. The first soldering portion 33 is formed by extending backward from the first fixing portion 31.

The second insulating body 2 includes a second base portion 21 and a second tongue plate 22. The second tongue plate 22 extends forwardly from the second base portion 21. The second terminals 4 are disposed on the second insulating body 2. Namely, the second terminals 4 run through the second base portion 21 and are disposed on the second tongue plate 22. Together, the first and second terminals 3 and 4 serve for USB 3.0 data communication. The second terminals 4 are made up by two pairs of high-frequency data transfer terminals and a ground terminal in-between. Each of the second terminals 4 has a second fixing portion 41, a second contacting portion 42, and a second soldering portion 43. The second fixing portion 41 is disposed on and runs thru the second base portion 21. The second contacting portion 42 is formed by extending forward from the second fixing portion 41 and disposed on the second tongue plate 22. The second soldering portion 43 is formed by extending backward from the second fixing portion 41. The first soldering portions 33 of the first terminals 3 and the second soldering portions 43 of the second terminals 4 are usually soldered to cables for establishing electrical connections. Thereby, a wired connector is created. However, the soldering portions can also be connected electrically to other devices without restrictions.

Figure 2:
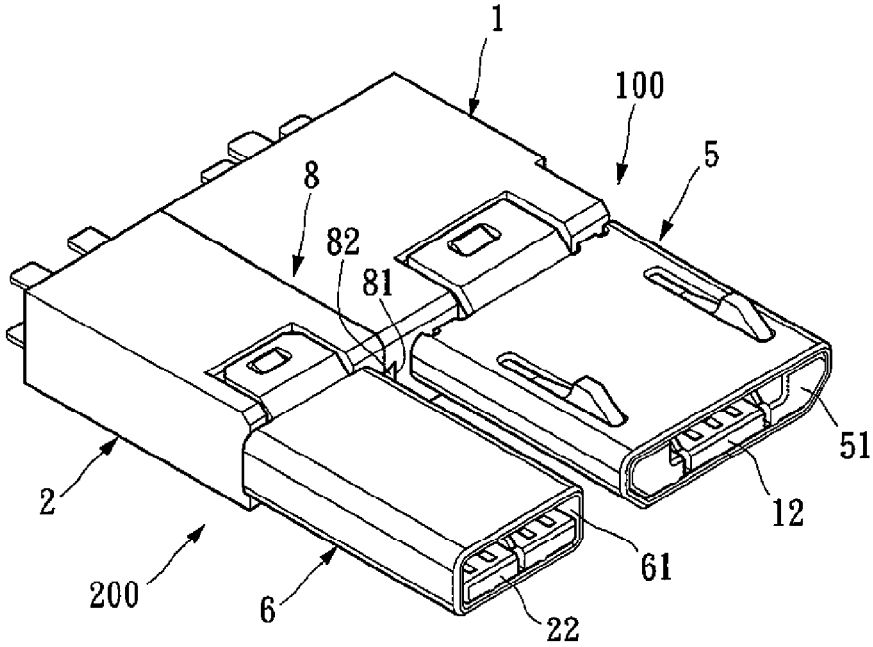
FIG. 2 shows another perspective view of the connector of the first embodiment.

Furthermore, the connector can further include a first cover 5 and a second cover 6 (shown in FIG. 2). The first cover 5 is disposed over the first insulating body 1 and the first terminals 3 thereof. A first enclosure 51 is defined by the first cover 5 to receive the first insulating body 1 and the first terminals 3. The second cover 6 is disposed over the second insulating body 2 and the second terminals 4 thereof. Likewise, a second enclosure 61 is defined by the second cover 6 to receive the second insulating body 2 and the second terminals 4.

A first module 100 is formed by the first insulating body 1 and the first terminals 3. Likewise, a second module 200 is formed by the second insulating body 2 and the second terminals 4. The first and second modules 100 and 200 are disposed in parallel, wherein each module is an independent unit. Thus, depends on application, each module can be used by itself or together with one another. The first and second modules 100 and 200 are coupled by a coupling unit, wherein the coupling technique is not restricted. The modules can be pivoted, slid, or wedged in a way to be maneuverable, wherein the mode of maneuverability is not restricted. For example, the modules can turn sideways, pivot up and down, or slide in-and-out. Also, one of the modules can be fixed with the other one be maneuverable, or both be maneuverable.

For the instant embodiment, the first and second modules 100 and 200 are coupled and slidable relative to each other. Namely, a sliding structure 8 is disposed horizontally in between the first and second modules 100 and 200. In particular, the sliding structure 8 can be disposed in between the first and second insulating bodies 1 and 2. The sliding structure 8 is not restricted structurally, which can be a pair of sliding members 81 and 82 that engage matchingly. For example, the sliding member 81 defined by a dovetailed recess can be formed on the first insulating body 1. Correspondingly, the sliding member 82 having a dovetailed protrusion is disposed on the second insulating body 2. The sliding members 81 and 82 work together to slidably connect the first insulating body 1 with the second insulating body 2.

Figure 3:
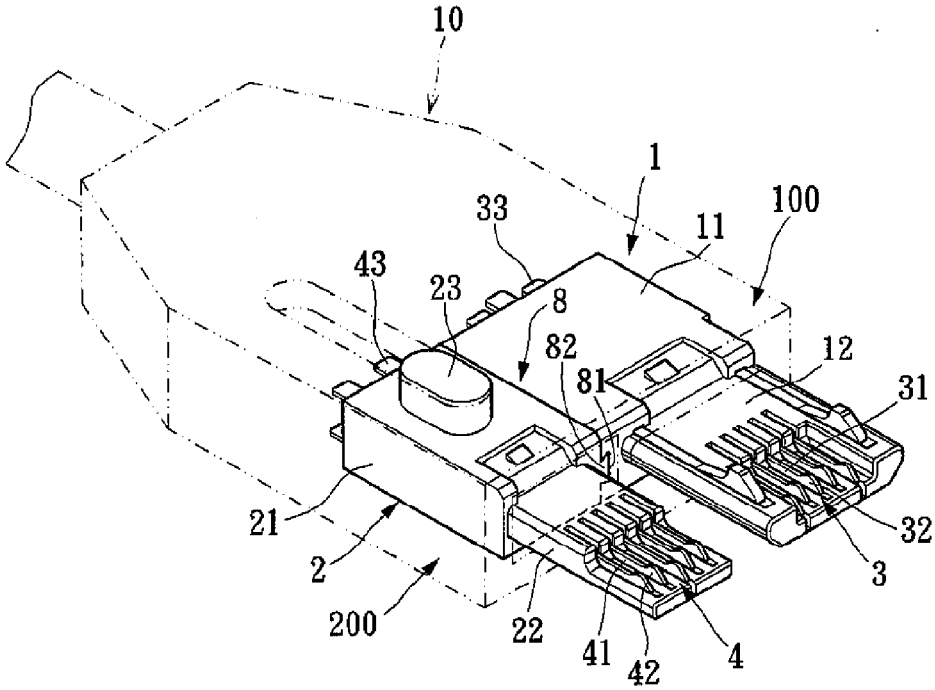
FIG. 3 shows a perspective view of the connector of the first embodiment in use.
Figure 4:
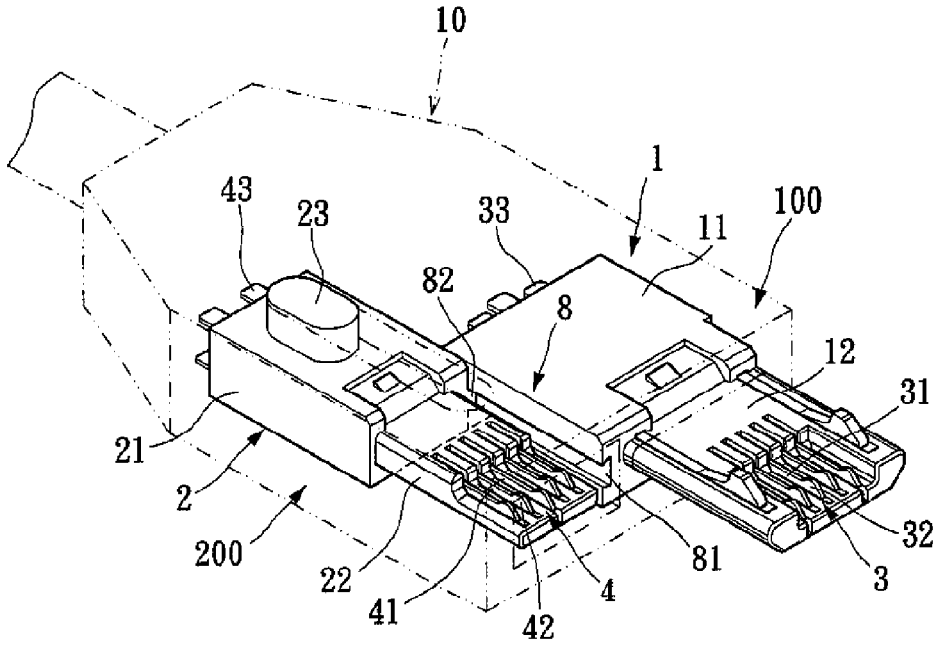
FIG. 4 shows another perspective view of the connector of the first embodiment in use.

For the instant embodiment, the first and second modules 100 and 200 are further received by a housing 10. The sliding structure 8 and the housing 10 form the coupling unit that slidably connects the first and second modules 100 and 200. The first and second modules 100 and 200 can slide relative to another. For the instant embodiment, the second module 200 can be retracted, or slide backward, as shown in FIG. 4. Thus, only the first module 100 is used for electrical connection. A pusher 23 can be disposed on the second insulating body 2 to slide the second module 200 inward or outward. Of course, the first and second modules 100 and 200 can be used simultaneously as indicated in FIG. 3.

Again, for the instant embodiment, the first module 100 is fixed to the housing 10, wherein the first module 100 is not slidable. Only the second module 200 is slidably disposed on the housing 10. Of course, both the first and second modules 100 and 200 can be slidably disposed on the housing 10. Alternatively, the first module 100 can be slidably disposed on the housing 10, while keeping the second module 200 fixed. In other words, for the modules to be used separately or jointly, only one of the module needs to be slidably disposed for the connector.

Second Embodiment

Figure 5:
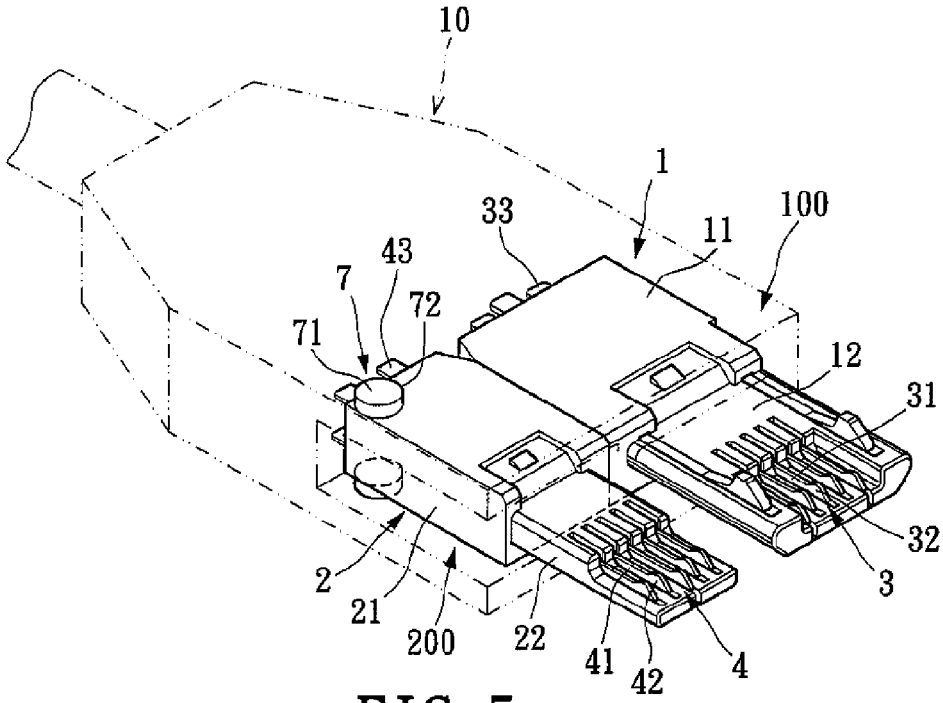
FIG. 5 shows a perspective view of a connector of a second embodiment of the instant disclosure in use.
Figure 6:
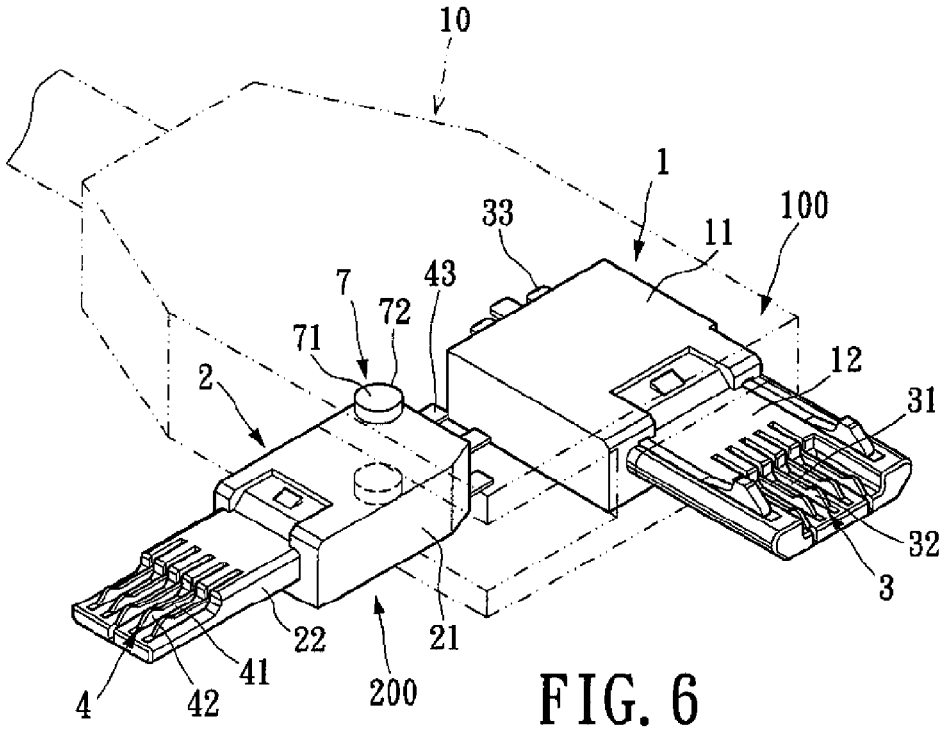
FIG. 6 shows another perspective view of the connector of the second embodiment in use.

Please refer to FIGS. 5 and 6, which show a second embodiment of the instant disclosure. For the second embodiment, the first and second modules 100 and 200 are pivotally mounted relative to each other on the housing 10 for turning sideways. A pivoting structure 7 is disposed at the rear of the second module 200, wherein the pivot axis of the second module 200 is along the plumb line. The pivoting structure 7 can be disposed in between the second module 200 and the housing 10. The pivoting structure 7 is not restricted structurally, which can include a short shaft through pivot holes. For example, a pivot shaft 71 can be disposed (or pivot holes formed) on the second insulating body 2. Correspondingly, pivot holes 72 can be formed (or a pivot shaft disposed) on the housing 10. The pivot shaft 71 and pivot holes 72 work together to mount the second insulating body 2 pivotally to the housing 10.

For the instant embodiment, the first and second modules 100 and 200 can be rotatably connected relative to each other, wherein the connection is due to the coupling unit formed by the pivoting structure 7 and the housing 10. The modules can be turned sideways relative to one another. As shown in FIG. 6, the second module 200 can be turned to one side. Thus, only the first module 100 is used for electrical connection. Of course, as shown in FIG. 5, both modules can be used for electrical connection. For the second embodiment, the first module 100 is fixed to the housing 10. Therefore, the first module 100 can not turn sideways. Only the second module 200 is pivotally mounted to the housing 10.

Not shown, the first and second modules 100 and 200 can be coupled by a snap structure. The snap structure can be disposed in between the first and insulating bodies 1 and 2, or among the first insulating body 1, the second insulating body 2, and the housing 10. The snap structure is not restricted structurally, which can be a pair of snapping members that engages matchingly to snap the first insulating body 1 with the second insulating body 2. The snap structure can also include snapping members that couples the first insulating body 1, the second insulating body 2, and the housing 10.

Third Embodiment

Figure 7:
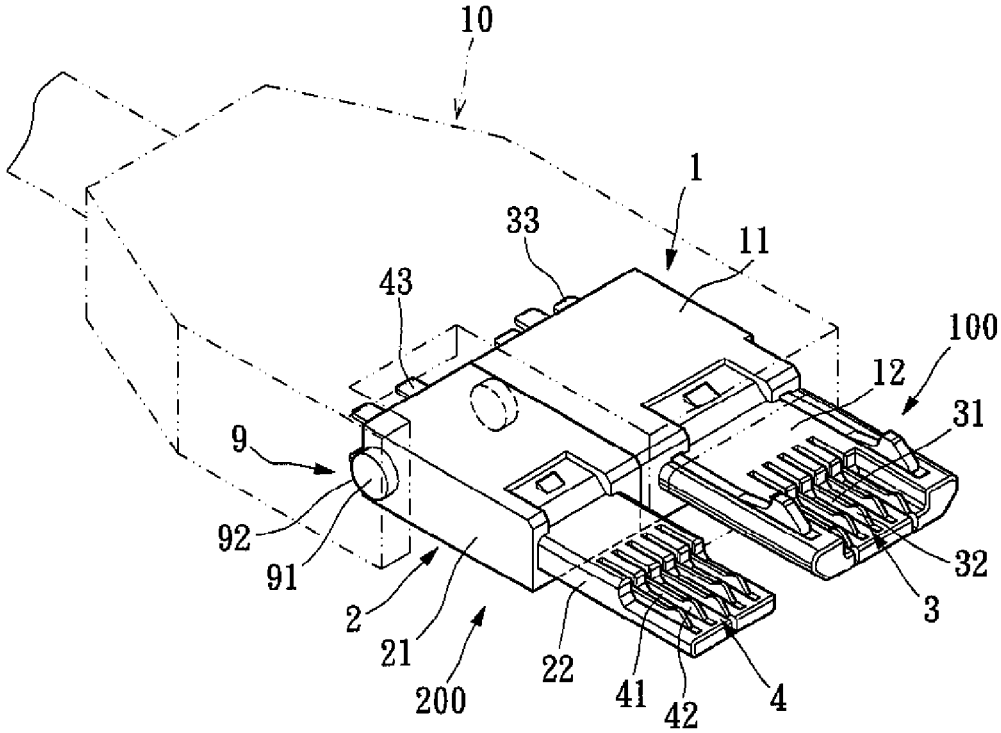
FIG. 7 shows a perspective view of a connector of a third embodiment of the instant disclosure in use.
Figure 8:
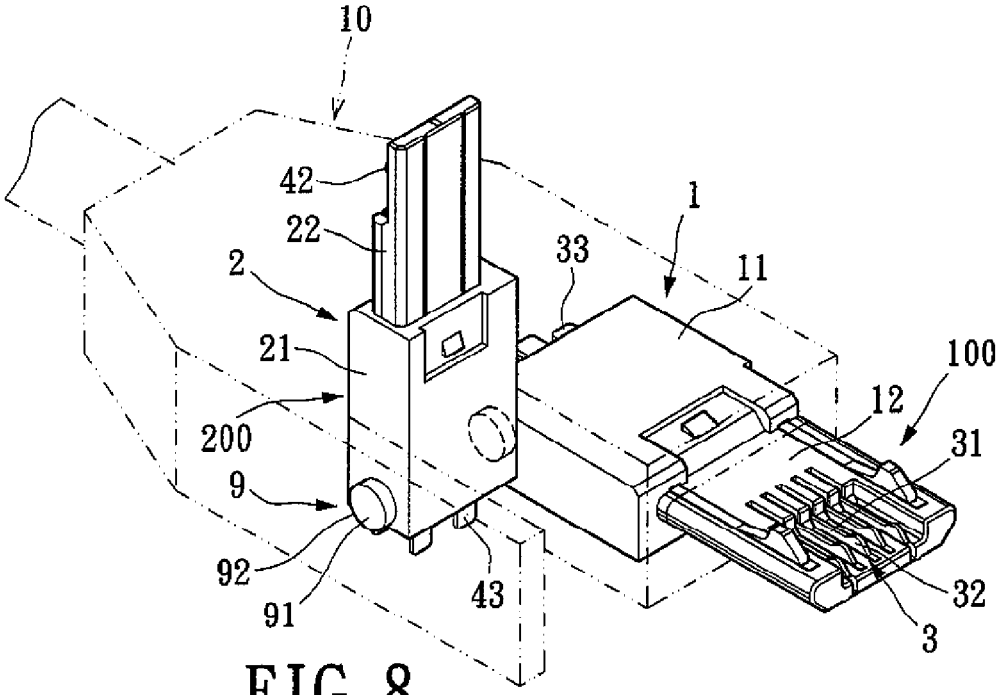
FIG. 8 shows another perspective view of the connector of the third embodiment in use.

Please refer to FIGS. 7 and 8, which show a third embodiment of the instant disclosure. For the third embodiment, the first and second modules 100 and 200 are pivotally mounted relative to each other on the housing 10, for flipping upward or downward. A pivoting structure 9 is disposed at the rear of the second module 200, wherein the pivot axis of the second module 200 runs through the first and second insulating bodies 1 and 2. The pivoting structure 9 can be disposed in between the second module 200 and the housing 10, or in between the first and second modules 100 and 200. The pivoting structure 9 is not restricted structurally, which can include a short shaft through pivot holes. For example, a pivot shaft 91 can be disposed (or pivot holes formed) on the second insulating body 2. Correspondingly, pivot holes 92 can be formed (or a pivot shaft disposed) on the housing 10. The pivot shaft 91 and pivot holes 92 work together to mount the second insulating body 2 pivotally to the housing 10.

For the instant embodiment, the first and second modules 100 and 200 can be movably combined relative to each other by the coupling unit, wherein the coupling unit is formed of the pivoting structure 9 and the housing 10. The modules can be flipped upward or downward relative to one another. As shown in FIG. 8, the second module 200 can be pointed upward or downward. Thus, only the first module 100 is used for electrical connection. Of course, as shown in FIG. 7, both modules can also be used simultaneously to make the electrical connection as well.

For the instant embodiment, the first module 100 is fixed to the housing 10. Therefore, the first module 100 can not be flipped. Only the second module 200 is flippably disposed on the housing 10. The first and second modules 100 and 200 can be coupled pivotally relative to one another by the pivoting structure 9. The pivoting structure 9 can be disposed in between the first and second insulating bodies 1 and 2, or among the first insulating body 1, the second insulating body 2, and the housing 10. The pivoting structure 9 can couple the first insulating body 1 with the second insulating body 2 pivotally, or for coupling the first insulating body 1, the second insulating body 2, and the housing 10 pivotally.

For the aforementioned embodiments, if one or more of the modules are movably disposed, a longer connecting cable is preferred to avoid snapping the cable, such as when turning or flipping the module. For the same reason, the connecting cable can also be allowed to pass through the pivoting structures 7 and 9 to ensure smooth operation of the connector.

Fourth, Fifth, and Sixth Embodiment

Figure 9:
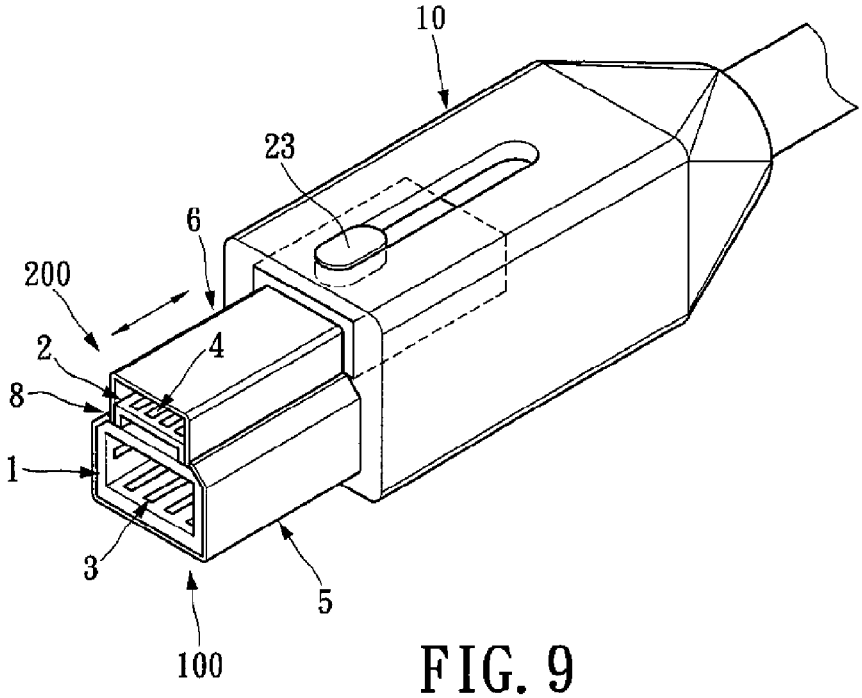
FIG. 9 shows a perspective view of a connector of a fourth embodiment of the instant disclosure in use.
Figure 10:
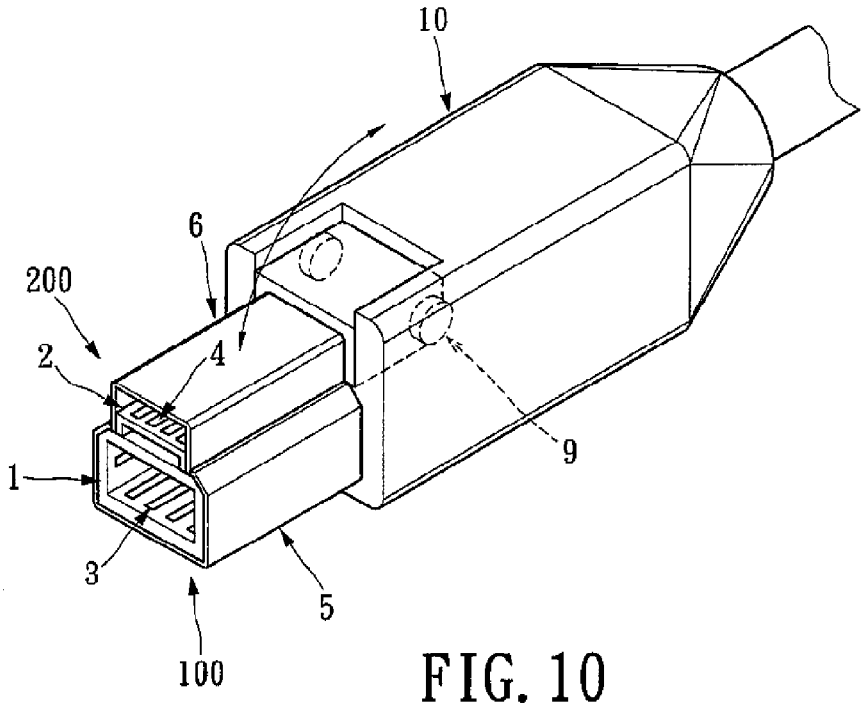
FIG. 10 shows a perspective view of a connector of a fifth embodiment of the instant disclosure in use.
Figure 11:
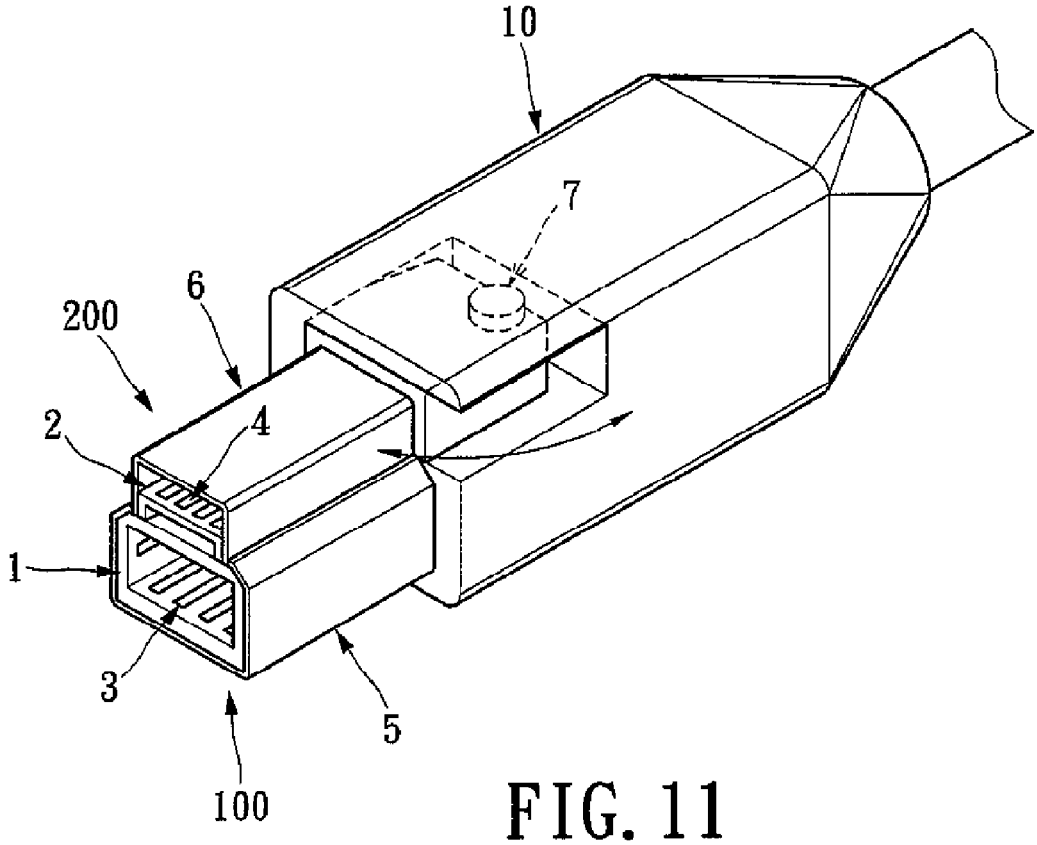
FIG. 11 shows a perspective view of a connector of a sixth embodiment of the instant disclosure in use.

Please refer to FIGS. 9, 10, and 11, which show a fourth, fifth, and sixth embodiment of the instant disclosure respectively. For the fourth, fifth, and sixth embodiment, a USB 3.0 Type B connector is disclosed. The connector includes the first insulating body 1, the second insulating body 2, the first terminals 3, the second terminals 4, the first cover 5, and the second cover 6. Structurally, the connector is generally similar to the first, second, and third embodiments. However, the connector is specifically of a USB 3.0 Type B connector. For the fourth, fifth, and sixth embodiment, each of the first module and second modules 100 and 200 is also an independent module by itself The first and second modules 100 and 200 are movably stacked relative to one another for using independently or jointly. The first and second modules 100 and 200 can be movably coupled relative to each other by the pivoting structure, sliding structure, or snap structure in addition to the housing 10. Relative to one another, the first and second modules 100 and 200 can be turned, slid, or flipped.

Also, the pivoting, sliding, and snap structures are not restricted in between the first and second insulating bodies 1 and 2. These structures can also be disposed in between the first and second covers 5 and 6, or among the first insulating body 1, the second insulating body 2, and the housing 10. Alternatively, a first outer cover (not shown) can be disposed over the first module 100, and a second outer cover (not shown) can be disposed over the second module 200. Then, the aforementioned structures can be disposed in between the first and second outer covers to form the coupling unit. Thus, the first and second modules 100 and 200 can be movably coupled relative to one another.

Seventh and Eighth Embodiment

Figure 12:
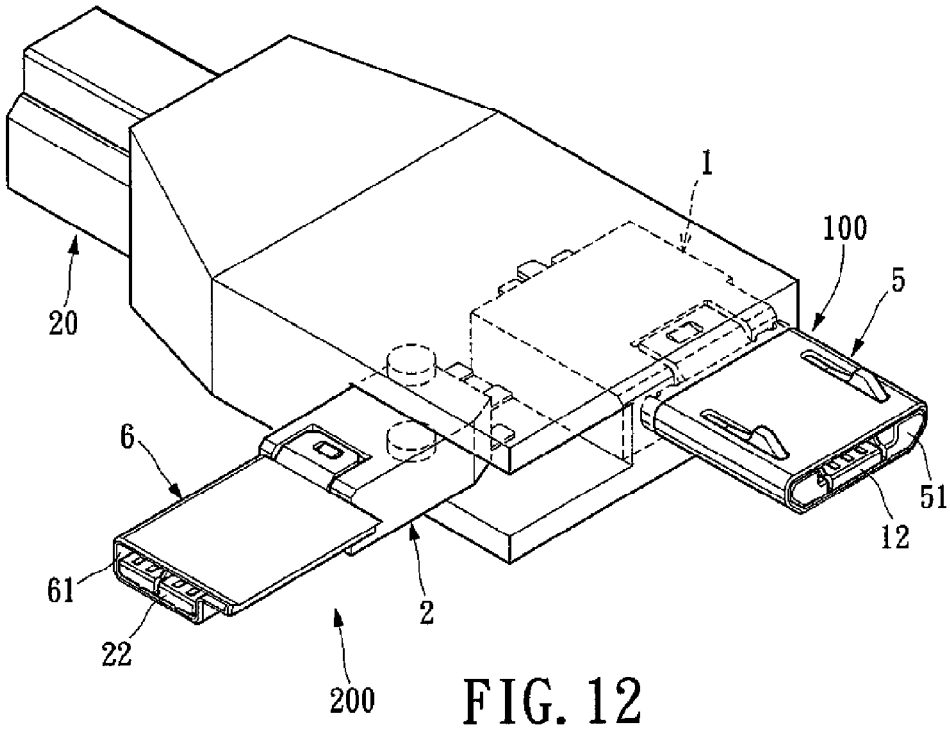
FIG. 12 shows a perspective view of a connector of a seventh embodiment of the instant disclosure in use.
Figure 13:
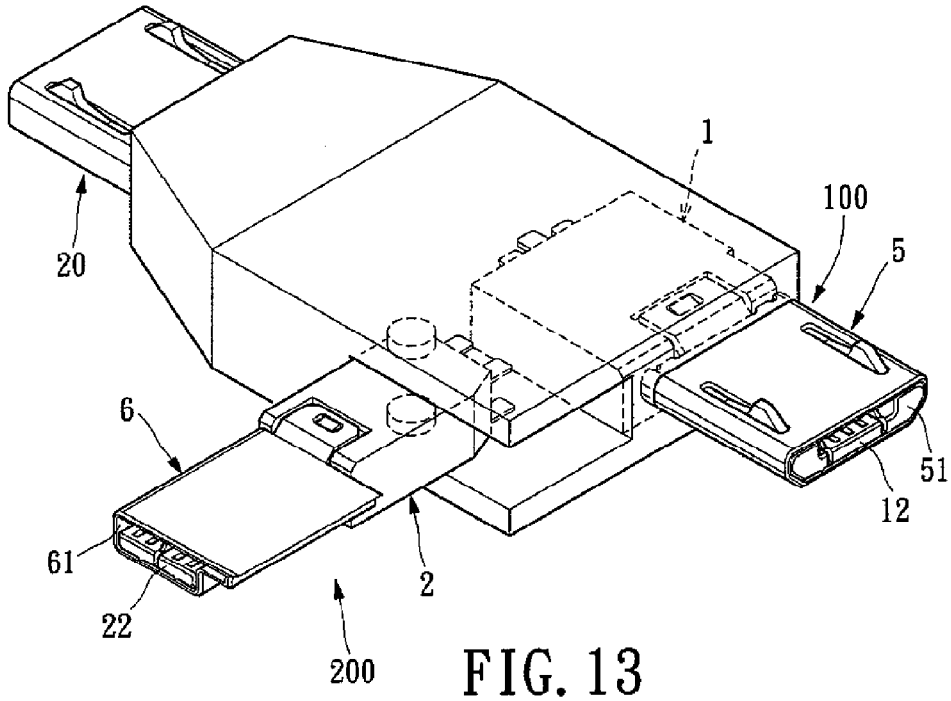
FIG. 13 shows a perspective view of a connector of an eighth embodiment of the instant disclosure in use.

Please refer to FIGS. 12 and 13, which show a seventh and eighth embodiment respectively. The instant embodiments disclose a USB 3.0 Micro-B type connector. The rear end of the connector is connected to another USB connector 20. In particular, the first soldering portion 33 of the first terminals 3 and the second soldering portion 43 of the second terminals 4 are connected electrically to the corresponding terminals (not shown) of the USB connector 20. Thus, an adapter is created. The USB connector 20 can be a USB 3.0 Type B connector (FIG. 12), USB 3.0 Type A connector (FIG. 13), or other types of connector.

Ninth, Tenth Embodiment

Figure 14:
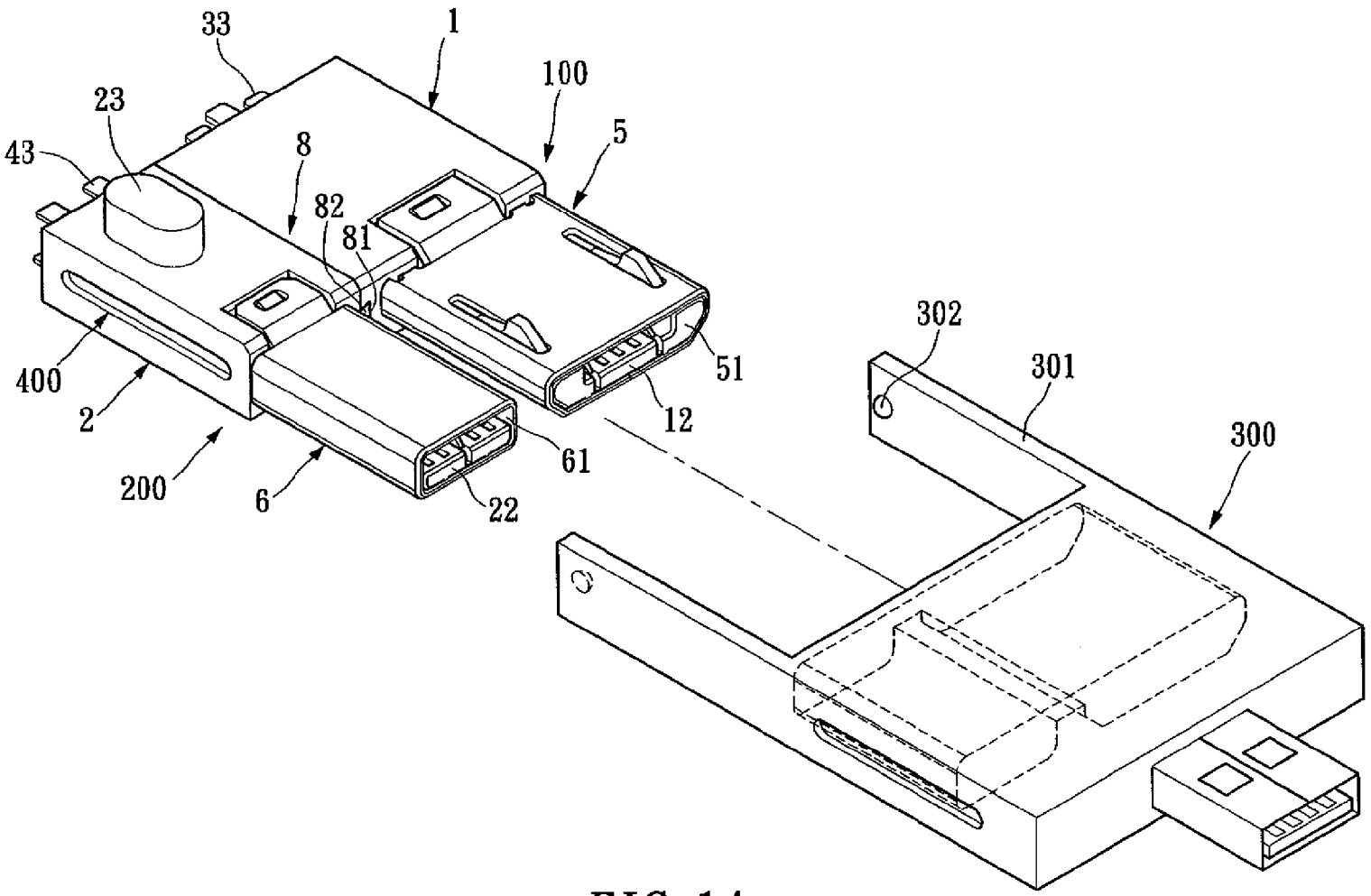
FIG. 14 shows a perspective view of a connector of a ninth embodiment of the instant disclosure in use.
Figure 15:
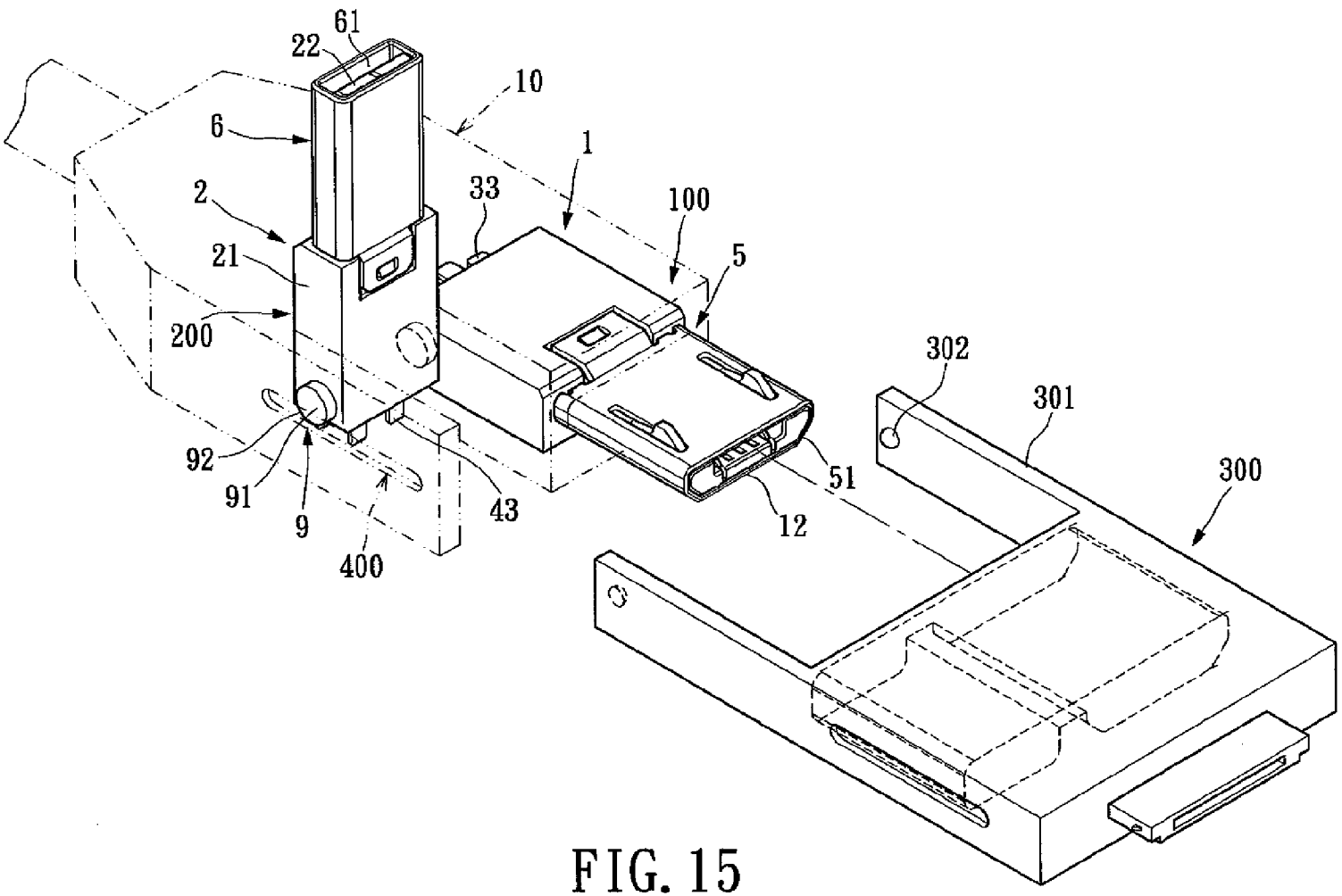
FIG. 15 shows a perspective view of a connector of a tenth embodiment of the instant disclosure in use.

Please refer to FIGS. 14 and 15, which show a ninth and tenth embodiments respectively. A groove 400 is slotted on each side surface of the connector for receiving an adapter 300. The adapter 300 has two arms 301, wherein each arm 301 has an engaging portion 302 formed on the inner surface thereof. An electrical connection is established when the connector engages the adapter 300. If not to be used, the engaging portion 302 can travel along the groove 400 to slide the adapter 300 away from the connector, such that the modules can be exposed. The exposed modules can be turned to different directions for use independently. The adapter 300 does not need to be dismounted completely from the connector, thereby providing convenience for the user.

In summary, the first and second modules 100 and 200 of the connector for the instant disclosure are movable relative to each other (e.g. pivoting, sliding, snapping). Each of the first and second modules 100 and 200 is an independent module. Based on application, the modules can be used separately or jointly to expand the connector's applicability.

The descriptions illustrated supra set forth simply the preferred embodiments of the instant disclosure; however, the characteristics of the instant disclosure are by no means restricted thereto. All changes, alternations, or modifications conveniently considered by those skilled in the art are deemed to be encompassed within the scope of the instant disclosure delineated by the following claims.

What is claimed is:

1. An adaptable USB connector for USB 2.0 and USB 3.0 connector interfaces, comprising:

a housing (10);

a first module (100) comprising a plurality of first terminals (3) exposedly disposed in a generally elongated first insulating body (1);

a second module (200) comprising a plurality of second terminals (4) exposedly disposed in a generally elongated second insulating body (2);

wherein the first and second modules (100, 200) are arranged abreast of each other and slidably coupled together through a dovetail sliding mechanism (81, 82) arranged there-between, the first and second modules cooperatively define a connector unit;

wherein the connector unit is slidably retractably disposed in the housing;

wherein when both the first and the second modules of the connector unit protrude from the housing, the connector unit conforms to USB 3.0 connector interface;

wherein when only the first module protrudes from the housing, the connector unit conforms to USB 2.0 connector interface;

wherein when both the first and the second modules are retracted, the connector unit is concealedly received in the housing.

2. The USB connector of claim 1, wherein the first insulating body has a first base portion and a first tongue plate, the first tongue plate extends forward from the first base portion, wherein the second insulating body has a second base portion a second tongue plate, the second tongue plate extends forward from the second base portion, wherein the first terminals run through the first base portion and dispose on the first tongue plate, and wherein the second terminals run through the second base portion and dispose on the second tongue plate.

3. The USB connector of claim 2, wherein each first terminal has a first fixing portion, a first contacting portion, and a first soldering portion, the first fixing portion is ran through and disposed on the first base portion, the first contacting portion protrudes forward from the first fixing portion and is disposed on the first tongue plate, the first soldering portion protrudes rearward from the first fixing portion.

4. The USB connector of claim 3, wherein each second terminal has a second fixing portion, a second contacting portion, and a second soldering portion, the second fixing portion is ran through and disposed on the second base portion, the second contacting portion protrudes forward from the second fixing portion and is disposed on the second tongue plate, the second soldering portion protrudes rearward from the second fixing portion.

5. The USB connector of claim 1, wherein the second terminals are defined by two pairs of high-frequency transfer terminals and a ground terminal disposed there-in-between.

6. The USB connector of claim 1, wherein a first cover shields the first insulating body and the first terminals, and wherein a second cover shields the second insulating body and the second terminals.

* * * * *